US011871818B2

(12) United States Patent
Chaillet

(10) Patent No.: US 11,871,818 B2
(45) Date of Patent: Jan. 16, 2024

(54) FOLDING BUCKLE CLASP FOR BRACELET

(71) Applicant: CARTIER INTERNATIONAL AG, Steinhausen (FR)

(72) Inventor: Romain Chaillet, Flangebouche (FR)

(73) Assignee: CARTIER INTERNATIONAL AG, Steinhausen (CH)

( * ) Notice: Subject to any disclaimer, the term of this patent is extended or adjusted under 35 U.S.C. 154(b) by 371 days.

(21) Appl. No.: 17/414,116

(22) PCT Filed: Dec. 16, 2019

(86) PCT No.: PCT/EP2019/085352
§ 371 (c)(1),
(2) Date: Jun. 15, 2021

(87) PCT Pub. No.: WO2020/127051
PCT Pub. Date: Jun. 25, 2020

(65) Prior Publication Data

US 2021/0307461 A1 Oct. 7, 2021

(30) Foreign Application Priority Data

Dec. 21, 2018 (CH) ..... 01589/18

(51) Int. Cl.
*A44C 5/24* (2006.01)

(52) U.S. Cl.
CPC ..... *A44C 5/24* (2013.01)

(58) Field of Classification Search
CPC ..... A44C 5/24
See application file for complete search history.

(56) References Cited

U.S. PATENT DOCUMENTS 5,735,629 A * 4/1998 Sakamoto ..... A44C 5/24 403/325
6,401,307 B1 6/2002 Wild
(Continued)

FOREIGN PATENT DOCUMENTS

DE 914446 2/1992
EP 0682300 11/1995
(Continued)

*Primary Examiner* — David M Upchurch
(74) *Attorney, Agent, or Firm* — DUANE MORRIS LLP; Gregory M. Lefkowitz

(57) ABSTRACT

Folding buckle clasp (1) designed to be attached to two bracelet strands or to a one-piece bracelet at two locations on the latter, comprising: —a first clasp element (3); —a second clasp element (7) hinged to said first element (3) via a hinge (9); —a locking system designed to keep said clasp in a folded-up state and to make it possible to put said clasp into an unfolded state in response to an action by a user; the locking system having —a spring-loaded pin (19) comprising a tubular body (19*a*) and at least one retractable stud (25) protruding axially from the tubular body (19*a*), said retractable stud (25) being subjected to a return force (F) that tends to keep said retractable stud (25) in an extended position, said pin (19) being situated in said first clasp element (3); —a cover (11) that is fastened to said second clasp element (7) and comprises at least one opening (27) having a shape corresponding to the retractable stud (25), said opening (27) being made in an inner face (11*a*) of the cover (11) and being able to cooperate with said retractable stud (25), —at least one pusher (29) mounted in said cover and designed to cooperate with said retractable stud (25) in order to remove the latter from said opening (27) in response to said action by the user.

12 Claims, 3 Drawing Sheets

(56) References Cited

U.S. PATENT DOCUMENTS

| | | | | |
|---|---|---|---|---|
| 10,945,497 | B2 * | 3/2021 | Catanese | A44C 5/246 |
| 2013/0286797 | A1 * | 10/2013 | Leger | G04B 37/14 24/316 |
| 2016/0113361 | A1 * | 4/2016 | Kaltenrieder | A44C 5/24 63/3.1 |
| 2016/0270492 | A1 * | 9/2016 | Kaltenrieder | A44C 5/14 |
| 2018/0352914 | A1 * | 12/2018 | Vuilleme | A44C 5/24 |
| 2018/0352915 | A1 * | 12/2018 | Yamashita | A44C 5/24 |

FOREIGN PATENT DOCUMENTS

| | | |
|---|---|---|
| EP | 09147781 | 5/1999 |
| FR | 803518 | 10/1936 |
| FR | 1516997 | 2/1968 |
| FR | 2867661 | 9/2005 |
| GB | 2297236 | 7/1996 |
| JP | H10192015 | 7/1998 |

* cited by examiner

FOLDING BUCKLE CLASP FOR BRACELET

CROSS-REFERENCE TO RELATED APPLICATIONS

This application is a § 371 national stage entry of International Application No. PCT/EP2019/085352, filed Dec. 16, 2019, which claims priority to Swiss Patent Application No. 01589/18, filed Dec. 21, 2018, the entire contents of which are incorporated herein by reference.

TECHNICAL FIELD

The present invention relates to the field of watchmaking and jewelry. It relates more particularly to a folding buckle clasp for a jewelry or watch bracelet.

PRIOR ART

Document US2018/352915 describes a bracelet clasp with a folding buckle comprising a first section that is articulated both to a strap of the bracelet and to a second section. This latter is also articulated in turn to a cover, to which another bracelet strap is attached. In order to ensure that the clasp is locked in the service position (i.e. in the folded position), the first section comprises a mushroom-shaped locking element that extends from a surface of the first section. The mushroom enters the cover in the service position, where it is kept in the locked state by sliding latches. In order to release the locking element, two pushbuttons are provided, extending laterally on either side of the cover. These pushbuttons are arranged so as to control the retraction of the latches, and this therefore causes the locking element to be released when they are actuated. In doing so, the clasp can be unfolded.

However, this arrangement is relatively complex, in particular in terms of the latches inside the cover, and is not very compact. In essence, the cover has to have a relatively large size in order to house the various components of the locking system.

The aim of the invention is therefore to provide a folding buckle in which the aforementioned defects are at least partially overcome.

DISCLOSURE OF THE INVENTION

More specifically, the invention relates to a folding buckle clasp for a bracelet, as defined by claim 1. This clasp is, of course, arranged so as to be attached either to two bracelet straps (as in the case of a watch bracelet), or to a one-piece bracelet at two points on this latter (as in the case of a jewelry bracelet). In this latter case, the bracelet is flexible or hinged so as to allow the clasp to be opened.

The bracelet comprises a first clasp element, a second clasp element articulated to said first element via a hinge, and also a locking system arranged so as to maintain said clasp in a folded state and allow the user to place said clasp in an unfolded state following a manual action.

According to the invention, the locking system comprises a spring bar comprising at least one retractable stud that axially protrudes from a tubular body comprised by said bar, said retractable stud being subjected to a return force that tends to maintain it in a moved-out position. This bar is situated in the first clasp element such that said stud can cooperate with a corresponding opening provided in an inner face of a cap that is fastened solidly or pivotably to the second clasp element. The term inner face denotes a face that is arranged so as to be directly facing the first element. The first element is therefore intended to be in contact with the arm of the wearer and can be considered as the lower element of the clasp, serving as a cradle on which the other element (or the other elements as will be seen below) is articulated.

In order to retract the stud, said cap further comprises at least one push button arranged so as to cooperate with said retractable stud in order to cause it to leave said opening, after a user presses on the push button. Typically, but not compulsorily, two retractable studs extending on either side of the bar are provided, each of these studs cooperating with a respective push button provided on either side of the cap.

This construction is in particular very compact, while at the same time allowing secure and reliable locking between the two elements of the clasp.

Advantageously, said push button cooperates directly or indirectly with the free extremity of said stud in order to push it toward the inside of said tubular body following a press by the user. In doing so, the stud is moved out of said opening so as to allow the clasp to be opened.

Advantageously, said bar extends between two lateral walls comprised by said first clasp element, said stud protruding from one of the lateral walls in the service position. Depending on whether the construction involves a single-fold clasp (i.e. a clasp with two blades) or a double-fold clasp (i.e. a clasp with three blades), these two lateral walls can be situated either at the free extremity of the first element (again, at the extremity thereof that does not comprise said hinge), or at a median position on this latter, as appropriate. These lateral walls can be arranged so as to nest inside said cap when the clasp is in its folded state.

Advantageously, said cap comprises at least one beveled surface situated on one of its inner faces, said beveled surface being arranged so as to push said retractable stud back automatically, i.e. without additional action, when said clasp is brought into its folded state from its unfolded state.

In a single-fold clasp construction, each of said clasp elements is arranged so as to be attached to a respective bracelet strap or to a respective point on a one-piece bracelet.

In a double-fold clasp construction, said clasp comprises a third clasp element that is also articulated to said first element and reprises the characteristics of said second element, in particular by being identical or symmetrical with respect to this latter. Two of said spring bars are situated one adjacent to the other, at a median position on said first element as mentioned above. Of course, in such a case, each bar is arranged so as to cooperate with a respective cap. In this construction, each of the second element and third element is arranged so as to be attached to a respective bracelet strap or to a respective point on a one-piece bracelet, the second element and the third element being articulated to the first element typically at two respective ends of this latter.

These constructions can be used in the context of a one-piece jewelry bracelet, or of a two-strap bracelet for a wristwatch, the bracelet or the bracelet straps being attached to the clasp as indicated above.

BRIEF DESCRIPTION OF THE DRAWINGS

Other details of the invention will become more clearly apparent upon reading the following description, given with reference to the appended drawings in which.

EMBODIMENT OF THE INVENTION

Figure 1:
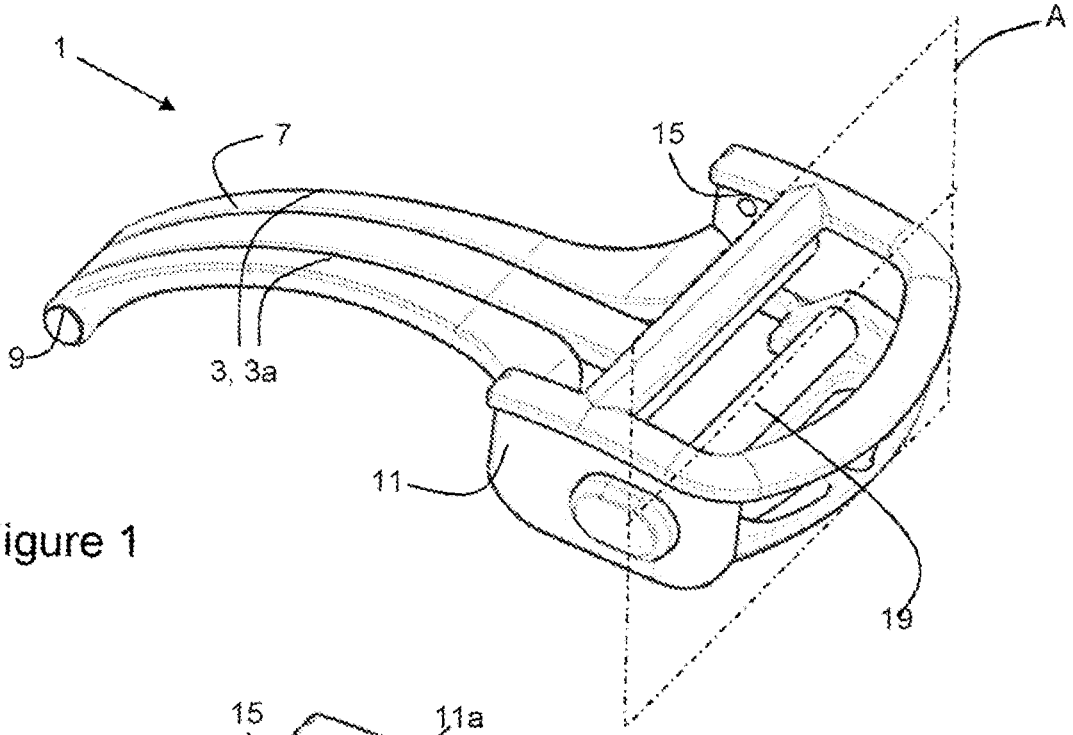
FIG. 1 is an isometric view of a clasp according to the invention, in the folded state.
Figure 2:
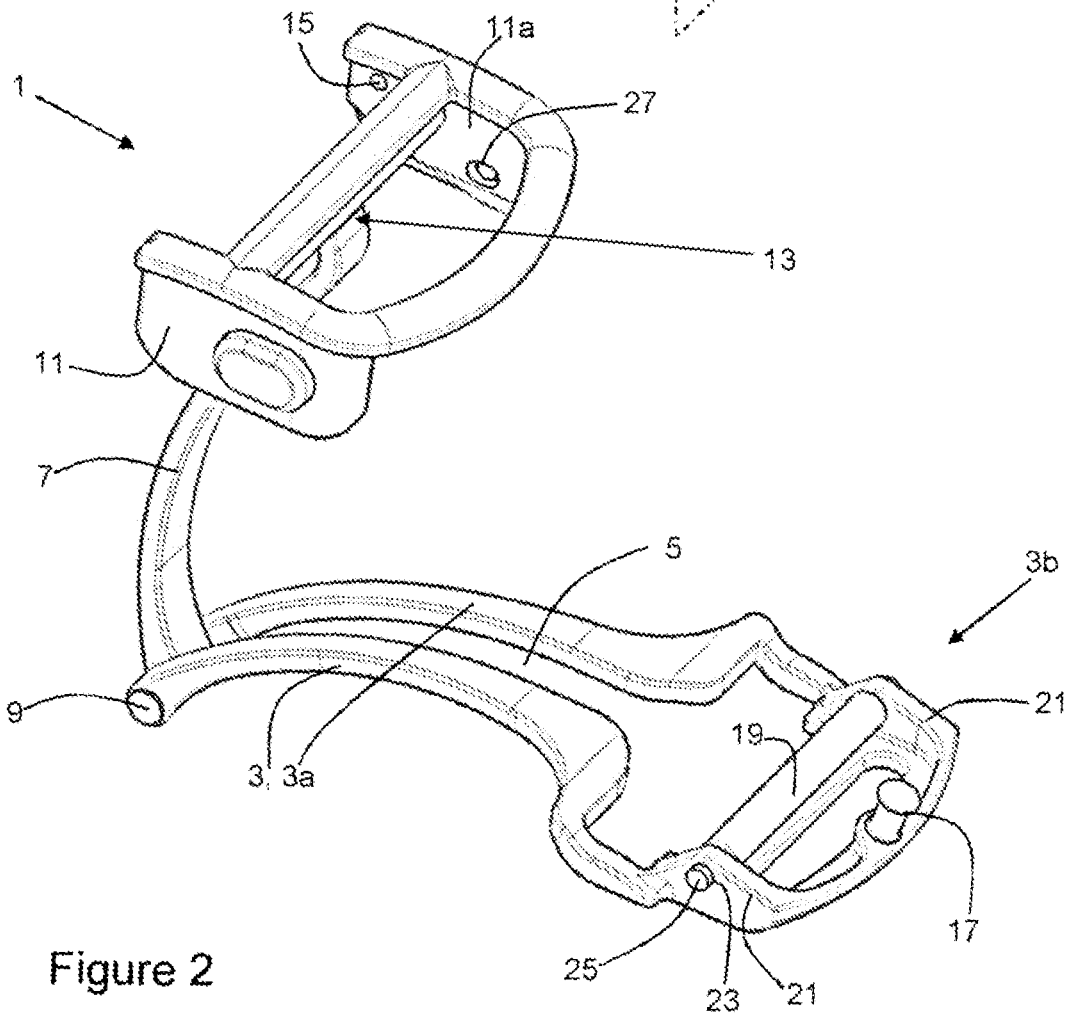
FIG. 2 is an isometric view of the clasp in FIG. 1 in the unfolded state.

FIGS. 1 and 2 illustrate a folding buckle clasp 1 according to the invention, respectively in the service (folded) position and in the deployed (unfolded) state.

The clasp 1 comprises a first clasp element 3 that is of elongate shape following the main axis of the clasp. This first element 3 is formed by a pair of side members 3*a* that are situated side by side such that they define an interstice 5 between them. This construction of the first element 3 can also be considered to be a split blade.

A second clasp element 7, also in the form of a blade that is elongate in the same direction, is articulated to said first element via a hinge 9 that connects an extremity of the first element 3 to an extremity of the second element 7. In the service position, the second element 7 is situated in the interstice 5 between the two side members 3*a* of the first element 3, such that it does not extend beyond the upper and lower faces of this latter, in order to maximize the comfort of the wearer. In the ideal case, the upper surface and lower surface of the second element 7 are substantially in the extension of the corresponding surface of the first element 3, but this is not obligatory.

The free extremity of the second element 7 bears a cap 11, articulated to this extremity via a corresponding hinge 13. Alternatively, the cap 11 can be secured to the second element, or can be integrated therein. The cap 11 comprises means for attaching an extremity of a bracelet (not shown) or a one-piece bracelet, as appropriate. In the illustrated embodiment, these means are a pair of openings 15, only one of which is visible in the figures, which are disposed facing one another in inner faces of the cap 11 and arranged so as to cooperate with the pivots of a conventional bar. Other configurations are also possible. The other bracelet strap or another part of a one-piece bracelet, as appropriate, can be attached to the first element via a peg 17 extending from the extremity 3*b* of the first element 3 toward the inside of the cap 11 when the clasp 1 is in the service position, or by any other appropriate attachment means, in particular by a pair of opposite openings similar to those provided in the cap 11.

The clasp 1 further comprises a locking system arranged so as to maintain it in its service position, i.e. in a folded state as illustrated in FIG. 1. This locking system is distributed between the first element 3 and the second element 7.

In the illustrated embodiment, the free extremity 3*b* of the first element 3, i.e. the extremity thereof that does not comprise the hinge 9, comprises a spring bar 19 extending between lateral walls 21 comprised by said extremity 3*b*. This spring bar 19 comprises, as is generally known, a tubular body 19*a* housing at least one elastic element such as a coil spring, an elastomer element or the like (shown schematically by the arrows F), this elastic element providing a return force that serves to maintain retractable studs 25 (often called "pivots"), with which the bar 19 is provided, in their respective moved-out positions, separated from one another.

Each lateral wall 21 is provided with a through-opening 23, in which a respective retractable stud 25 is accommodated, the tubular body 19*a* being situated between the lateral walls 21. Alternatively, the tubular body 19*a* of the bar can pass through these openings 23, in particular in the case in which this body is secured to the lateral walls 21 by being adhesively bonded, welded, force-fitted, crimped or similar.

Figure 3:
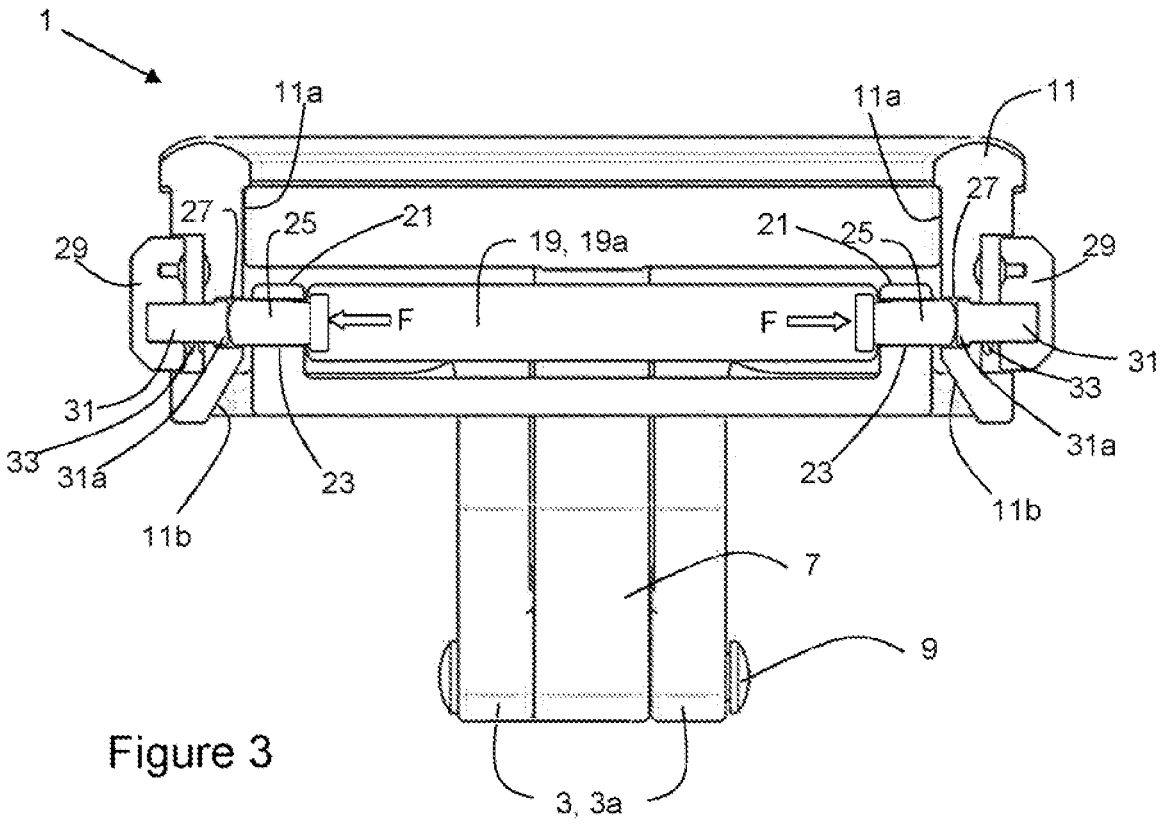
FIG. 3 is a sectional view on the plane A in FIG. 1, this plane intersecting the spring bar.
Figure 4:
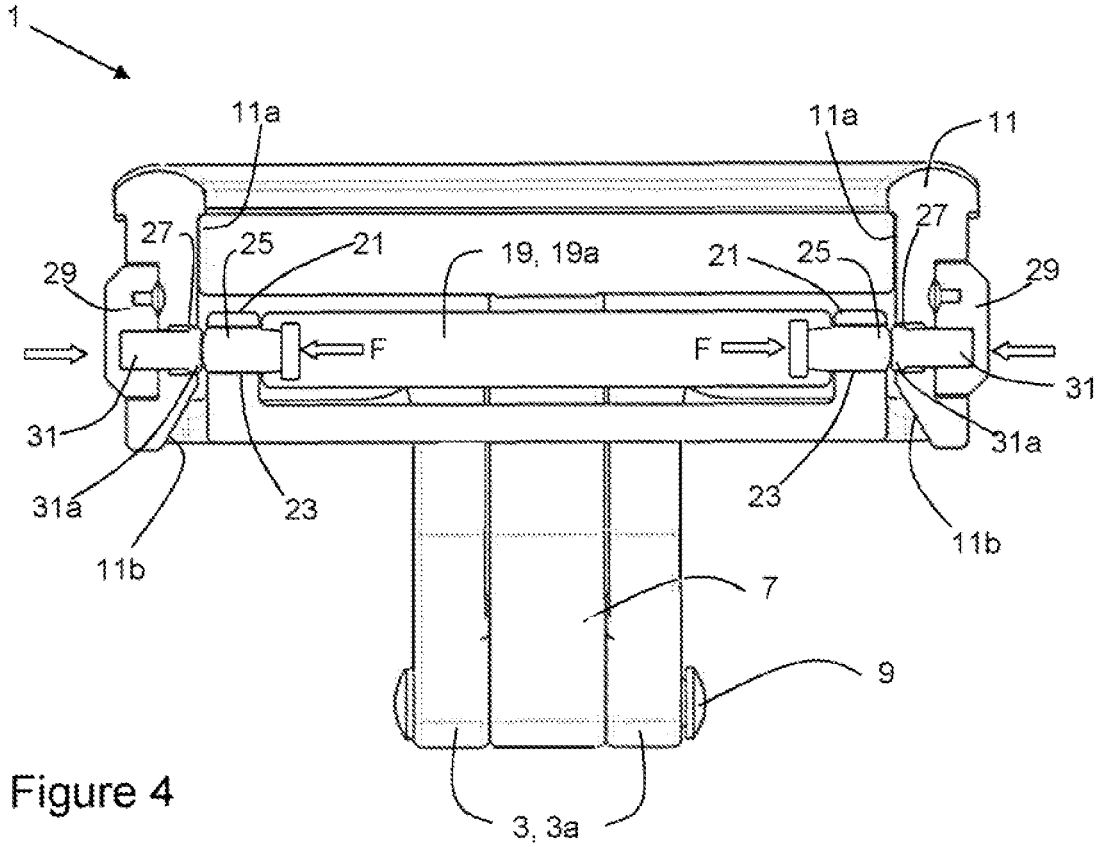
FIG. 4 is a view similar to that of FIG. 3, the push buttons having been depressed.

In the service position (see FIGS. 1 and 3), the lateral walls 21 nest inside the cap 11. The studs 25 protrude from the lateral walls 21, and are accommodated in corresponding openings provided in inner lateral faces 11*a* of the cap, such that they are held there by the action of the elastic element. In this state, the cooperation between the studs 25 and the openings 27 therefore makes it possible to lock the cap 11 on the lateral walls 21 of the free extremity 3*b* of the first clasp element 3, and thus to maintain the clasp 1 in its folded state.

In order to cause the studs 25 to leave the openings 27 in the cap 11, each stud 25 is able to cooperate with a corresponding push button 29 with which the cap 11 is provided. Each push button 29 moves in translation as one with an actuating finger 31 that is accommodated in said corresponding opening 27 and is coaxial with the studs 25 of the spring bar 19. Each actuating finger 31 also comprises a flange 31*a* situated at its free end. When the corresponding push button 29 is released, this flange abuts against a shoulder comprised by said opening 27, in order to maintain the push button assembled to the cap 11. A respective spring 33 is arranged between each push button 29 and the cap 11 in order to serve as a return spring, serving to maintain the push button 29 in its rest (non-depressed) position. Of course, other push button 29 constructions are also possible, in which the push buttons cooperate directly or indirectly with the studs 25.

When the user depresses the push buttons 29, the fingers 31, which move in translation as one with the push buttons, press against the free ends of the studs 25 of the spring bar 19. The studs 25 are then forced to move closer to each other, against the return force F. In doing so, these latter are released from the openings 27 in the cap 11, and this separates said cap from the free extremity 3*b* of the first element 3. The second element 7 can hence be pivoted relative to the first element 3, thus unfolding the clasp 1, in order to bring it into the state illustrated in FIG. 2. When the cap 11 is moved away from the extremity 3*b*, the studs 25 automatically return to their rest position under the effect of the force F, as soon as the fingers 31 are no longer acting upon them.

When the user closes the clasp 1, the user does not necessarily need to press the push buttons 29, even though he can do this. When the studs 25 begin to go back inside the cap 11, beveled surfaces 11*b*, comprised by the inner faces 11*a* of this latter, cause retraction of the studs 25, which subsequently drop back into the openings 27 under the effect of the force F. The clasp is then in its service (folded) state.

In a variant that is not shown, it is possible to provide only one push button 29, the retractable extremity 25 of the bar 19 that is not associated with the push button 29 being spherical or rounded so as to act as a ball detent. In doing so, this extremity can therefore leave the opening 27 on its own, when the two elements 3, 7 are pivoted with respect to one another following the depression of the single push button 29.

Furthermore, it is also possible to inverse the overall shapes of the first clasp element and second clasp element 3, 7, the first element having a single blade that is accommodated between two side members comprised by the second element.

The shapes of the clasp elements 3, 7 can also be adapted to the needs of the manufacturer, in particular in terms of their curvatures, the number of side members, blades, etc. For example, the second element 7 can be superimposed on the first element 3 in the service position instead of being nested between the side members 3*a*, this being a configuration that is advantageous in particular in the case in which the two elements 3, 7 are made of stamped sheet metal. It should also be noted that the first part 3 can extend significantly beyond the hinge 9.

Figure 5:
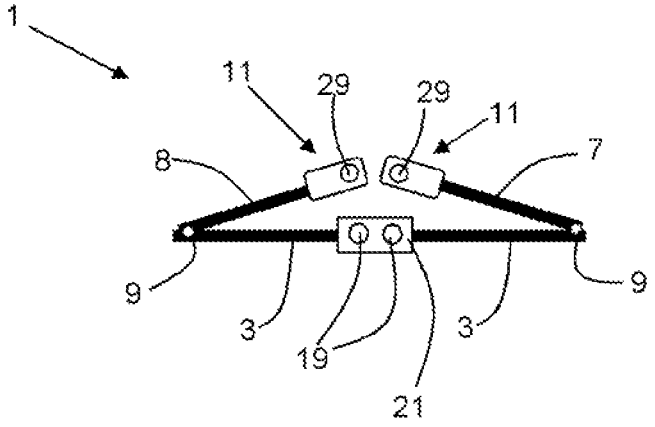
FIG. 5 is a schematic view of a triple-blade clasp.

FIG. 5 schematically illustrates a double folding buckle clasp 1, which comprises a third element 8 similar to the second element 7 described above, each of these elements being articulated to a respective extremity of the first clasp element 3. At a median point on this latter (in the middle thereof in the present case) are two spring bars 9, extending between lateral walls 21 and each cooperating with a respective cap 11 comprised by each of the second element 7 and the third element 8. Each cap 11 is intended to be fastened to an ad hoc point on a bracelet (strap), and can be released from the first element 3 by depressing the push buttons 29 that it comprises, in the same way as described above. Consequently, in such a variant, the first element 3 is not intended to directly bear one extremity of a bracelet (strap), but is linked thereto indirectly via the second element 7 and third element 8.

Furthermore, the same construction variations mentioned above can also be applied to this variant with a double-fold clasp.

Although the invention has been described above in connection with a specific embodiment as well as a few explicit variants, yet other additional variants are also conceivable without departing from the scope of the invention as defined by the claims.

The invention claimed is:

1. A folding buckle clasp, arranged so as to be attached to two bracelet straps or to a one-piece bracelet at two points on this latter, comprising:

a first clasp element;

a second clasp element articulated to said first element via a hinge;

a locking system arranged so as to maintain said clasp in a folded state and allow said clasp to be placed in an unfolded state in response to an action by a user;

characterized in that said locking system comprises:

a spring bar comprising a tubular body and at least one retractable stud that axially protrudes from the tubular body, said retractable stud being subjected to a return force that tends to maintain said retractable stud in a moved-out position, said bar being situated in said first clasp element;

a cap fastened to said second clasp element and comprising at least one opening, said opening being provided in an inner face of the cap and being able to cooperate with said retractable stud, at least one push button mounted in said cap and arranged so as to cooperate with said retractable stud in order to cause it to leave said opening in response to said action by the user.

2. The clasp according to claim 1, wherein said push button cooperates with the free extremity of said retractable stud in order to push it toward the inside of said tubular body in response to said action by the user.

3. The clasp according to claim 1, wherein said bar extends between two lateral walls comprised by said first clasp element, said stud protruding from one of said lateral walls in the service position.

4. The clasp according to claim 3, wherein said lateral walls are arranged so as to nest inside said cap when the clasp is in its folded state.

5. The clasp according to claim 3, wherein said cap comprises at least one beveled surface situated on one of its inner faces and arranged so as to cause said retractable stud to retract when said clasp is brought into its folded state from its unfolded state.

6. The clasp according to claim 1, wherein each of said clasp elements is arranged so as to be attached to a respective bracelet strap or to a respective point on a one-piece bracelet.

7. The clasp according to claim 1, comprising a third clasp element that is articulated to said first element and comprises the same characteristics as said second element, two of said bars being situated one adjacent to the other at a median position on said first element and arranged so as to cooperate one with the cap of said second element and the other with the cap of said third element.

8. The clasp according to claim 7, wherein each of said second clasp element and third clasp element is arranged so as to be attached to said bracelet or to each of said bracelet straps, as appropriate.

9. A bracelet comprising a clasp according to claim 1.

10. The bracelet according to claim 9, comprising a one-piece bracelet attached to said clasp at two points on said bracelet.

11. The bracelet according to claim 8, comprising two bracelet straps each attached to said clasp.

12. A wristwatch comprising a bracelet according to claim 10.

* * * * *